US010217424B2

(12) United States Patent
Kim et al.

(10) Patent No.: US 10,217,424 B2
(45) Date of Patent: Feb. 26, 2019

(54) LIQUID CRYSTAL DISPLAY UTILIZING A TIMING CONTROLLER FOR CHANGING POLARITY ARRANGEMENT AND METHOD OF DRIVING THE SAME

(71) Applicant: SAMSUNG DISPLAY CO., LTD., Yongin-si, Gyeonggi-do (KR)

(72) Inventors: Jinpil Kim, Suwon-si (KR); Seunghwan Moon, Asan-si (KR); Jung-won Kim, Seoul (KR); Dongwon Park, Asan-si (KR); Jaesung Bae, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 200 days.

(21) Appl. No.: 15/162,508

(22) Filed: May 23, 2016

(65) Prior Publication Data

US 2017/0069278 A1 Mar. 9, 2017

(30) Foreign Application Priority Data

Sep. 9, 2015 (KR) ..... 10-2015-0127852

(51) Int. Cl.
*G09G 3/36* (2006.01)
*G09G 3/20* (2006.01)

(52) U.S. Cl.
CPC ..... *G09G 3/3614* (2013.01); *G09G 3/2003* (2013.01); *G09G 3/2018* (2013.01); *G09G 3/3688* (2013.01); *G09G 2300/0426* (2013.01); *G09G 2310/027* (2013.01); *G09G 2310/08* (2013.01); *G09G 2320/0209* (2013.01)

(58) Field of Classification Search
None
See application file for complete search history.

(56) References Cited

U.S. PATENT DOCUMENTS

2001/0004253 A1* 6/2001 Fukutoku ..... G09G 3/3614 345/96
2008/0278466 A1* 11/2008 Joo ..... G09G 3/3614 345/205
2014/0139558 A1* 5/2014 Tseng ..... G09G 3/3648 345/690

FOREIGN PATENT DOCUMENTS

JP 2003-114655 A 4/2003
KR 10-0870018 B1 11/2008
KR 10-1337130 B1 12/2013
KR 10-1341904 B1 12/2013

(Continued)

*Primary Examiner* — Amr A Awad
*Assistant Examiner* — Donna V Lui
(74) *Attorney, Agent, or Firm* — Lewis Roca Rothgerber Christie LLP

(57) ABSTRACT

A liquid crystal display includes a liquid crystal panel including a plurality of gate lines extending in a first direction, a plurality of data lines extending in a second direction crossing the first direction, and a plurality of pixels connected to the gate lines and the data lines, a gate driver configured to apply gate signals to the gate lines, a data driver configured to apply data voltages to the data lines, and a timing controller configured to receive a control signal and image data, to apply a gate control signal to the gate driver, and to apply a data control signal to the data driver, wherein the timing controller is further configured to determine whether to change a present polarity arrangement on a basis of a color ratio of the image data.

16 Claims, 16 Drawing Sheets

(56) References Cited

FOREIGN PATENT DOCUMENTS

| | | | |
|---|---|---|---|
| KR | 10-1374425 | B1 | 3/2014 |
| KR | 10-2014-0086713 | A | 7/2014 |

* cited by examiner

LIQUID CRYSTAL DISPLAY UTILIZING A TIMING CONTROLLER FOR CHANGING POLARITY ARRANGEMENT AND METHOD OF DRIVING THE SAME

CROSS-REFERENCE TO RELATED APPLICATION

This U.S. non-provisional patent application claims priority to and the benefit of Korean Patent Application No. 10-2015-0127852, filed on Sep. 9, 2015 in the Korean Intellectual Property Office (KIPO), the content of which is hereby incorporated by reference in its entirety.

BACKGROUND

1. Field

The present disclosure relates to a liquid crystal display and a method of driving the same.

2. Description of the Related Art

A liquid crystal display forms an electric field in a liquid crystal layer disposed between two substrates and changes an alignment of liquid crystal molecules of the liquid crystal layer to control a transmittance of light passing through the liquid crystal layer, and thus, a desired image is displayed through the liquid crystal display.

A method of driving the liquid crystal display is classified into a line inversion method, a column inversion method, and a dot inversion method, according to a phase of a data voltage applied to data lines. The line inversion method inverts the phase of image data applied to data lines of every pixel row, the column inversion method inverts the phase of the image applied to the data lines of every pixel column, and the dot inversion method inverts the phase of the image data applied to the data lines of every pixel row and every pixel column.

In general, a display apparatus displays colors using three primary colors of red, green, and blue. Accordingly, the display apparatus includes sub-pixels respectively corresponding to the red, green, and blue colors. In recent years, a display apparatus that displays the colors using red, green, blue, and other primary colors has been developed. As the other primary colors, one or more of the magenta, cyan, yellow, and white colors are used. In addition, a display apparatus including red, blue, green, and white sub-pixels has been suggested in order to improve brightness of the image. To this end, red, green, and blue image signals from an external source are applied to a display panel after being converted to red, green, blue, and white data signals.

SUMMARY

Aspects of embodiments of the present inventive concept are directed toward a liquid crystal display capable of changing a polarity arrangement of pixels under a specific condition to prevent a moving line-stain from being recognized and a horizontal crosstalk from occurring. Further aspects are directed toward a method of driving the liquid crystal display.

According to some embodiments of the inventive concept, there is provided a liquid crystal display including: a liquid crystal panel including a plurality of gate lines extending in a first direction, a plurality of data lines extending in a second direction crossing the first direction, and a plurality of pixels connected to the gate lines and the data lines; a gate driver configured to apply gate signals to the gate lines; a data driver configured to apply data voltages to the data lines; and a timing controller configured to receive a control signal and image data, to apply a gate control signal to the gate driver, and to apply a data control signal to the data driver, wherein the timing controller is further configured to determine whether to change a present polarity arrangement on a basis of a color ratio of the image data.

In an embodiment, the timing controller includes: a present polarity arrangement decider configured to determine whether the present polarity arrangement is any one of a first polarity arrangement, a second polarity arrangement, a third polarity arrangement, and a fourth polarity arrangement; a first polarity modulation determination circuit configured to analyze the color ratio of the image data when the present polarity arrangement is one of the first and second polarity arrangements, and to determine whether to change the present polarity arrangement to another one of the first and second polarity arrangements; and an inverting signal generator configured to generate an inverting signal determined by one polarity arrangement among the first to fourth polarity arrangements in accordance with the determination of the present polarity arrangement decider and the first polarity modulation determination circuit.

In an embodiment, the first polarity modulation determination circuit includes: an individual-color grayscale detector configured to analyze the image data to detect an individual-color grayscale value of pixel data; a grayscale compensator configured to apply an individual-color weighted value and an individual-color brightness ratio to the individual-color grayscale value of the pixel data to compensate the individual-color grayscale value; a color pattern detector configured to determine whether a color pattern is detected from the image data on the basis of the color ratio of the image data; and a first output circuit configured to determine whether to change the present polarity arrangement in accordance with whether a number of frame periods during which the image data having the color pattern are consecutively input is equal to or greater than a set number of frame periods.

In an embodiment, when the data voltages having the first polarity arrangement are applied to the liquid crystal panel, first and second color line patterns extend in the second direction and third and fourth color line patterns extend in a direction crossing the first and second directions, and when the data voltages having the second polarity arrangement are applied to the liquid crystal panel, the first and second color line patterns extend in a direction crossing the first and second directions, and the third and fourth color line patterns extend in the second direction.

In an embodiment, a polarity of the first polarity arrangement and a polarity of the second polarity arrangement are inverted every k data lines, k being a natural number.

In an embodiment, the timing controller further includes a second polarity modulation determination circuit configured to analyze whether a unit pattern is detected from the image data when the present polarity arrangement is one of the third and fourth polarity arrangements, and to determine whether to change the present polarity arrangement to another one of the third and fourth polarity arrangements.

In an embodiment, the second polarity modulation determination circuit includes: a grayscale detector configured to analyze the image data to detect a grayscale value of pixel data; a unit pattern detector configured to determine whether the unit pattern is detected from the image data on a basis of the grayscale value of the pixel data; and a second output circuit configured to determine whether to change the present polarity arrangement in accordance with whether a number of the detected unit patterns is equal to or greater than a set number of the unit patterns in the image data.

In an embodiment, a polarity of the third polarity arrangement is inverted every i data lines of the plurality of data lines, a polarity of the fourth polarity arrangement is inverted every p data lines of the plurality of data lines, wherein i is a natural number smaller than k, and p is a natural number smaller than i.

In an embodiment, k is 4, i is 2, and p is 1.

In an embodiment, the first polarity arrangement is represented as +, +, −, +, −, −, +, and −, the second polarity arrangement is represented as +, −, +, −, −, +, −, and +, the third polarity arrangement is represented as +, +, −, −, +, +, −, and −, and the fourth polarity arrangement is represented as +, −, +, −, +, −, +, and −, wherein + represents a data voltage having a positive polarity and − represents a data voltage having a negative polarity.

In an embodiment, the liquid crystal panel includes: a first pixel group; a second pixel group adjacent to the first pixel group in the first direction; a third pixel group adjacent to the first pixel group in the second direction; and a fourth pixel group adjacent to the second pixel group in the second direction, each of the first, second, third, and fourth pixel groups including an even number of pixels, and the first, second, third, and fourth pixels groups are repeatedly arranged in the first and second directions.

In an embodiment, each of the first and fourth pixel groups includes two pixels among a red pixel, a green pixel, a blue pixel, and a white pixel, and each of the second and third pixel groups includes an other two pixels among the red pixel, the green pixel, the blue pixel, and the white pixel.

In an embodiment, the pixels in one pixel column are alternately connected to two data lines of the plurality of data lines in units of at least one pixel and the two data lines are adjacent to each other such that the pixel column is between the two data lines.

In an embodiment, the pixels in one pixel row are connected to a same gate line of the plurality of gate lines.

According to some embodiments of the inventive concept, there is provided a method of driving a liquid crystal display, the method including: determining whether a present polarity arrangement applied to image data is a first or second polarity arrangement of a first polarity arrangement, a second polarity arrangement, a third polarity arrangement, and a fourth polarity arrangement; analyzing a color ratio of the image data when the present polarity arrangement is the first polarity arrangement or the second polarity arrangement to determine whether to change the present polarity arrangement; analyzing whether a unit pattern is detected from the image data when the present polarity arrangement is the third polarity arrangement or the fourth polarity arrangement to determine whether to change the present polarity arrangement; and determining a final polarity arrangement on a basis of the determined results with respect to the analyzing of the color ratio and the analysis of the unit pattern.

In an embodiment, the determining of the present polarity arrangement with respect to the analyzing of the color ratio includes: analyzing the image data to detect an individual-color grayscale value of pixel data; applying an individual-color weighted value and an individual-color brightness ratio to the individual-color grayscale value of the pixel data to compensate the individual-color grayscale value of the pixel data; determining whether a color pattern having a polarity arrangement to be changed is detected from the image data on a basis of the color ratio of the image data; and determining whether a number of frame periods during which the image data having the color pattern are consecutively input is equal to or greater than a set number of frame periods when the color pattern having the polarity arrangement to be changed is detected from the image data.

In an embodiment, the present polarity arrangement is maintained when the color pattern is not detected or the number of frame periods during which the image data having the color pattern are consecutively input is smaller than the set number of frame periods, and wherein the present polarity arrangement is changed when the color pattern is detected or the number of frame periods during which the image data having the color pattern are consecutively input is equal to or greater than the set number of frame periods.

In an embodiment, the determining of the present polarity arrangement with respect to the detecting of the unit pattern includes: analyzing the image data to detect a grayscale value of pixel data; determining whether the unit pattern is detected from the image data; and determining whether a number of the detected unit patterns is equal to or greater than a set number of the unit patterns in the image data corresponding to one frame period.

In an embodiment, the present polarity arrangement is maintain when the unit pattern is not detected or the number of the detected unit patterns is smaller than the set number of the unit patterns in the image data corresponding to one frame period, and the present polarity arrangement is changed when the unit pattern is detected or the number of the detected unit patterns is equal to or greater than the set number of the unit patterns in the image data corresponding to one frame period.

According to embodiments of the above, the polarity arrangement is changed under a specific condition, and thus the moving line-stain may be prevented or substantially prevented from being perceived.

In addition and according to embodiments of the above, the polarity arrangement is changed under a specific condition, and thus occurrence of a horizontal crosstalk may be prevented or substantially reduced.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

The following description with reference to the accompanying drawings is provided to assist in a comprehensive understanding of various embodiments of the present disclosure as defined by the claims and their equivalents. The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

Hereinafter, the present invention will be explained in detail with reference to the accompanying drawings.

Figure 1:
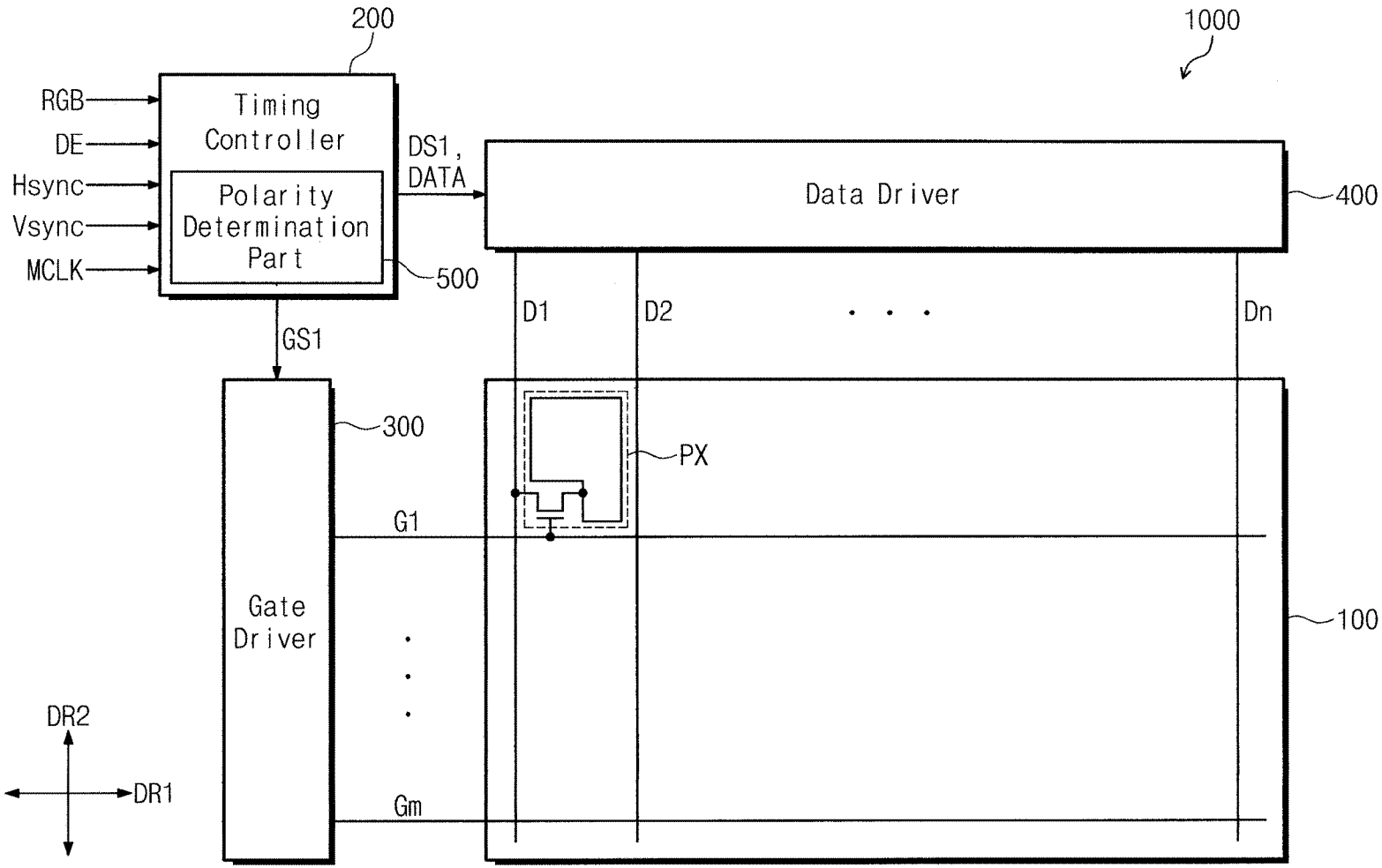
FIG. 1 is a block diagram showing a liquid crystal display according to an exemplary embodiment of the present disclosure.
Figure 2:
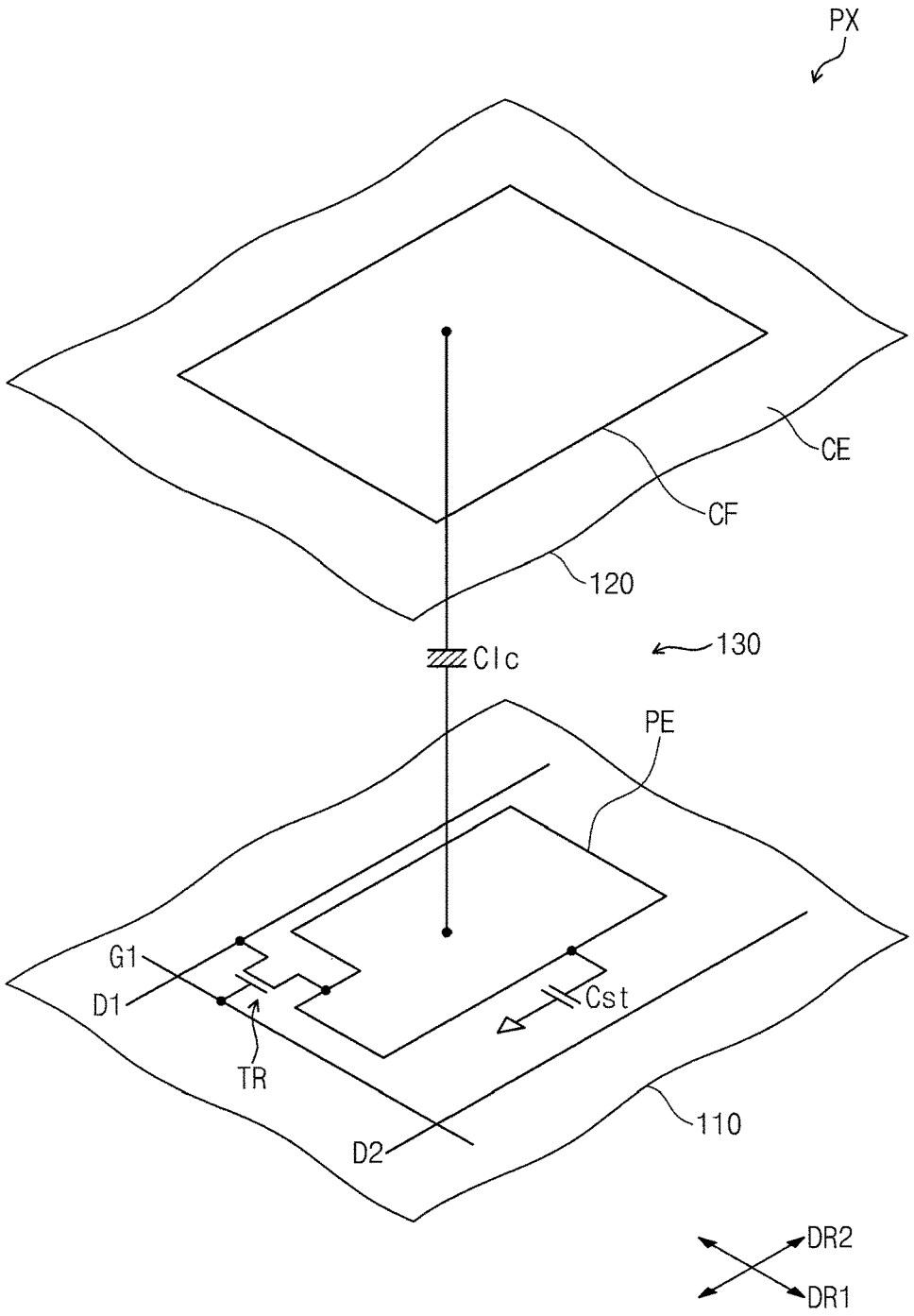
FIG. 2 is an equivalent circuit diagram showing one pixel shown in FIG. 1.

FIG. 1 is a block diagram showing a liquid crystal display 1000 according to an exemplary embodiment of the present disclosure. FIG. 2 is an equivalent circuit diagram showing one pixel PX shown in FIG. 1.

Referring to FIG. 1, the liquid crystal display 1000 includes a liquid crystal panel 100, a timing controller 200, a gate driver 300, and a data driver 400.

The liquid crystal panel 100 includes a lower substrate 110, an upper substrate 120 facing the lower substrate 110, and a liquid crystal layer 130 interposed between the lower and upper substrates 110 and 120.

The liquid crystal panel 100 includes a plurality of gate lines G1 to Gm extending in a first direction DR1 and a plurality of data lines D1 to Dn extending in a second direction DR2 crossing (e.g., substantially perpendicular to) the first direction DR1. The gate lines G1 to Gm and the data lines D1 to Dn define pixel areas (at their respective crossing regions) and pixels PX are respectively disposed in the pixel areas. FIG. 2 shows the pixel PX connected to a first gate line G1 and a first data line D1.

Each pixel PX includes a thin film transistor TR connected to a corresponding gate line of the gate lines G1 to Gm, a liquid crystal capacitor Clc connected to the thin film transistor TR, and a storage capacitor Cst connected to the liquid crystal capacitor Clc in parallel. The storage capacitor Cst may be omitted if desired. The thin film transistor TR is disposed on the lower substrate 110. The thin film transistor TR includes a gate electrode connected to the first gate line G1, a source electrode connected to the first data line D1, and a drain electrode connected to the liquid crystal capacitor Clc and the storage capacitor Cst.

The liquid crystal capacitor Clc includes a pixel electrode PE disposed on the lower substrate 110 and a common electrode CE disposed on the upper substrate 120 as its two terminals, and the liquid crystal layer 130 disposed between the pixel electrode PE and the common electrode CE serves as a dielectric substance. The pixel electrode PE is connected to the thin film transistor TR and the common electrode CE is disposed on an entire surface of the upper substrate 120 to receive a common voltage. In some examples, the common electrode CE may be disposed on the lower substrate 110 according to embodiments, and in this case, at least one of the pixel electrode PE and the common electrode CE includes slits.

The storage capacitor Cst assists the liquid crystal capacitor Clc and includes the pixel electrode PE, a storage line, and an insulating layer disposed between the pixel electrode PE and the storage line. The storage line is disposed on the lower substrate 110 to overlap with a portion of the pixel electrode PE. The storage line has applied thereto a constant voltage, e.g., a storage voltage.

The pixel PX displays one of first, second, third, and fourth colors. The first to fourth colors include red, green, blue, and white colors; however, embodiments of the present disclosure are not limited thereto or thereby. The first to fourth colors may include four colors different from each other. The pixel PX may further include a color filter CF to represent one of the first to fourth colors. In FIG. 2, the color filter CF is disposed on the upper substrate 120; however, embodiments of the present disclosure are not limited thereto or thereby. For example, the color filter CF may be disposed on the lower substrate 110.

The timing controller 200 receives image data RGB and control signals from an external graphic controller. The control signals include a vertical synchronization signal Vsync as a frame distinction signal, a horizontal synchronization signal Hsync as a row distinction signal, a data enable signal DE maintained at a high level during a period, in which data are output, to indicate a data input period, and a main clock signal MCLK.

The timing controller 200 includes a polarity determination part (e.g., a polarity determination circuit) 500. The polarity determination part 500 analyzes the image data RGB and determines a polarity arrangement, which is to be output, when determining that a present polarity arrangement of the image data RGB is required to be modulated. The polarity determination part 500 outputs the determined polarity arrangement as an inversion signal. The polarity determination part 500 will be described in further detail below.

The timing controller 200 converts the image data RGB according to the specifications of the data driver 400. The timing controller 200 applies the converted data DATA to the data driver 400. The timing controller 200 generates a gate control signal GS1 and a data control signal DS1. The gate control signal GS1 is applied to the gate driver 300, and the data control signal DS1 is applied to the data driver 400.

The gate control signal GS1 is used to drive the gate driver 300, and the data control signal DS1 is used to drive the data driver 400.

The gate driver 300 generates gate signals in response to the gate control signal GS1 and applies the gate signals to the gate lines G1 to Gm. The gate control signal GS1 includes a scan start signal for indicating a start of scanning, at least one clock signal for controlling an output period of a gate on voltage, and an output enable signal for controlling the maintenance of the gate on voltage.

The data driver 400 generates grayscale voltages corresponding to the image data DATA in response to the data control signal DS1 and applies the grayscale voltages to the data lines D1 to Dn as data voltages. The data voltages include a positive (+) data voltage having a positive value with respect to the common voltage, and a negative (−) data voltage having a negative value with respect to the common voltage. The data control signal DS1 includes a horizontal start signal STH for indicating a start of the transmission of the image data DATA to the data driver 400, a load signal for indicating application of data voltages to the data lines D1 to Dn, and an inverting signal for inverting a polarity of the data voltages with respect to the common voltage.

The data driver 400 inverts the polarity of the data voltages applied to the data lines D1 to Dn at every frame. The data driver 400 constantly maintains the polarity of the data voltages applied to the data lines D1 to Dn during one frame period.

The polarity of the data voltages applied to the liquid crystal panel 100 is inverted after one frame is finished and before a next frame starts so as to prevent or substantially prevent the liquid crystals from burning or deteriorating. For instance, the data driver 400 inverts the polarity of the data voltages every frame period in response to the inverting signal applied thereto. In addition, when the image corresponding to one frame is displayed, the data voltages having different polarities are output in the unit of at least one data line and applied to the pixels to improve display quality.

Each of the timing controller 200, the gate driver 300, and the data driver 400 is directly mounted on the liquid crystal panel 100, attached to the liquid crystal panel 100 in a tape carrier package form after being mounted on a flexible printed circuit board, or mounted on a separate printed circuit board. In some examples, at least one of the gate driver 300 and the data driver 400 may be integrated on the liquid crystal panel 100 together with the gate lines G1 to Gm, the data lines D1 to Dn, and the thin film transistor TR. In addition, the timing controller 200, the gate driver 300, and the data driver 400 may be integrated in a single chip.

The liquid crystal display 1000 may further include a backlight unit. The backlight unit is disposed under the liquid crystal panel 100 to provide light to the liquid crystal panel 100.

Figure 3:
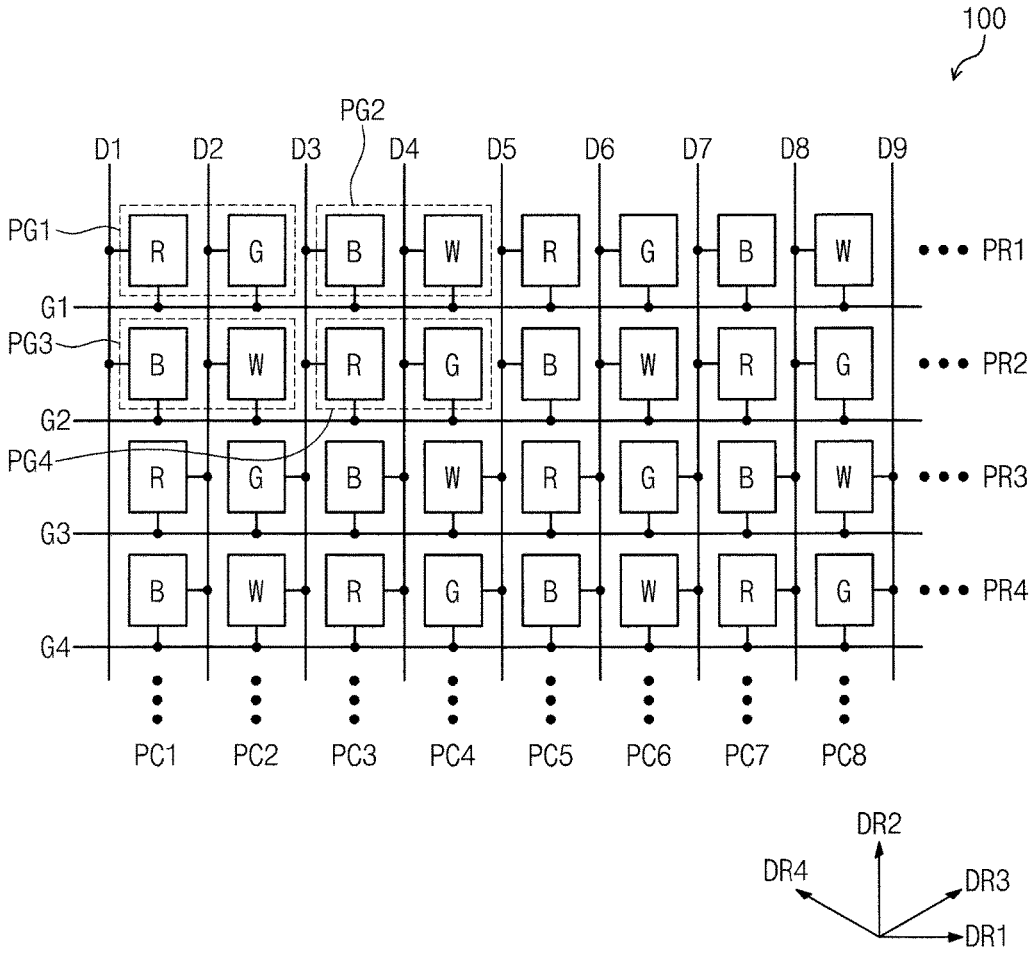
FIG. 3 is a plan view showing a portion of a liquid crystal panel according to an exemplary embodiment of the present disclosure.

FIG. 3 is a plan view showing a portion of a liquid crystal panel according to an exemplary embodiment of the present disclosure.

Referring to FIG. 3, the liquid crystal panel 100 includes first, second, third, and fourth pixel groups PG1, PG2, PG3, and PG4. The first and second pixel groups PG1 and PG2 are disposed adjacent to each other in a first direction DR1. The third and fourth pixel groups PG3 and PG4 are disposed adjacent to each other in the first direction DR1. The first and third pixel groups PG1 and PG3 are disposed adjacent to each other in a second direction DR2. The second and fourth pixel groups PG2 and PG4 are disposed adjacent to each other in the second direction DR2.

Each of the first to fourth pixel groups PG1 to PG4 includes an even number of pixels. In FIG. 3, each of the first to fourth pixel groups PG1 to PG4 includes two pixels.

Each of the first to fourth pixel groups PG1 to PG4 displays a portion of the first to fourth colors. Each of the first and fourth pixel groups PG1 and PG4 includes a red pixel and a green pixel. Each of the second and third pixel groups PG2 and PG3 includes a blue pixel and a white pixel. In the present exemplary embodiment, the red, green, blue, and white pixels are respectively indicated by R, G, B, and W as shown in FIG. 3.

The first to fourth pixel groups PG1 to PG4 are repeatedly arranged in the first and second directions DR1 and DR2.

However, the order of arrangement of the pixels should not be limited to that shown in FIG. 3. For example, the colors of the pixels included in the first to fourth pixels PG1 to PG4 may be changed in various ways. In further detail, each of the first and fourth pixel groups PG1 and PG4 may include the red and blue pixels and each of the second and third pixel groups PG2 and PG3 may include the green and white pixels. In addition, each of the first and fourth pixel groups PG1 and PG4 may include the red and white pixels, and each of the second and third pixel groups PG2 and PG3 may include the green and blue pixels.

Among the pixels, pixels arranged adjacent to each other in the first direction DR1 are collectively referred to as a pixel row. FIG. 3 shows first, second, third, and fourth pixel rows PR1, PR2, PR3, and PR4. Among the pixels, pixels arranged adjacent to each other in the second direction DR2 is are collectively referred to as a pixel column. FIG. 3 shows first, second, third, fourth, fifth, sixth, seventh, and eighth pixel columns PC1, PC2, PC3, PC4, PC5, PC6, PC7, and PC8. Hereinafter, a position of the pixels is indicated by a corresponding row and column. For instance, the red pixel R connected to the first gate line G1 and the first data line D1 is referred to as a first-row first-column pixel.

The pixels included in the same pixel column are alternately connected to two data lines adjacent to each other such that the pixel column is disposed between the two data lines in the unit of at least one pixel (i.e., the connection of the pixels included in the pixel column alternates between the two adjacent data lines every unit pixel, which is at least one pixel). In the present exemplary embodiment, the pixels included in the same pixel column are alternately connected to two data lines adjacent to each other such that the pixel column is disposed between the two data lines in the unit of two pixels. For instance, among the pixels included in the first pixel column PC1, the first-row first-column red pixel R is connected to the first data line D1, a second-row first-column blue pixel B is connected to the first data line D1, a third-row first-column red pixel R is connected to a second data line D2, and a fourth-row first column blue pixel B is connected to the second data line D2.

The pixels included in the same pixel row are connected to the same gate line. For instance, the pixels included in the first pixel row PR1 are connected to the first gate line G1.

Referring again to FIG. 2, the liquid crystal panel 100 receives the data voltages having one polarity arrangement of the first, second, third, and fourth polarity arrangements. The polarity determination part 500 analyzes the image data RGB and selects one of the first to fourth polarity arrangements to output the selected polarity arrangement as the inverting signal. The data driver 400 receives the inverting signal and outputs the data voltages having one polarity arrangement of the first to fourth polarity arrangements to the data lines D1 to Dn.

Hereinafter, the first to fourth polarity arrangements will be described with reference to FIGS. 4A to 4D.

Figure 4A:
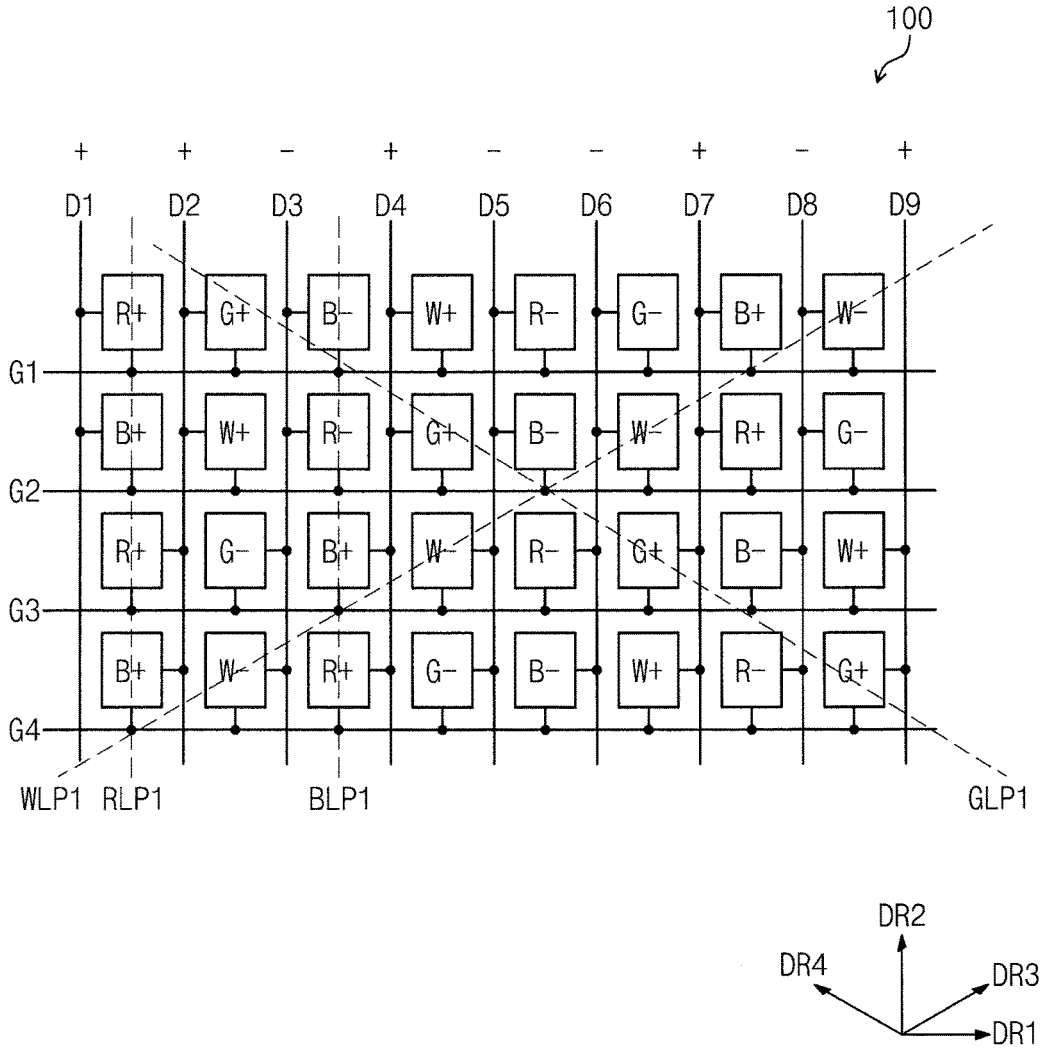
FIG. 4A is a view showing a liquid crystal panel to which data voltages having a first polarity arrangement are applied.
Figure 4B:
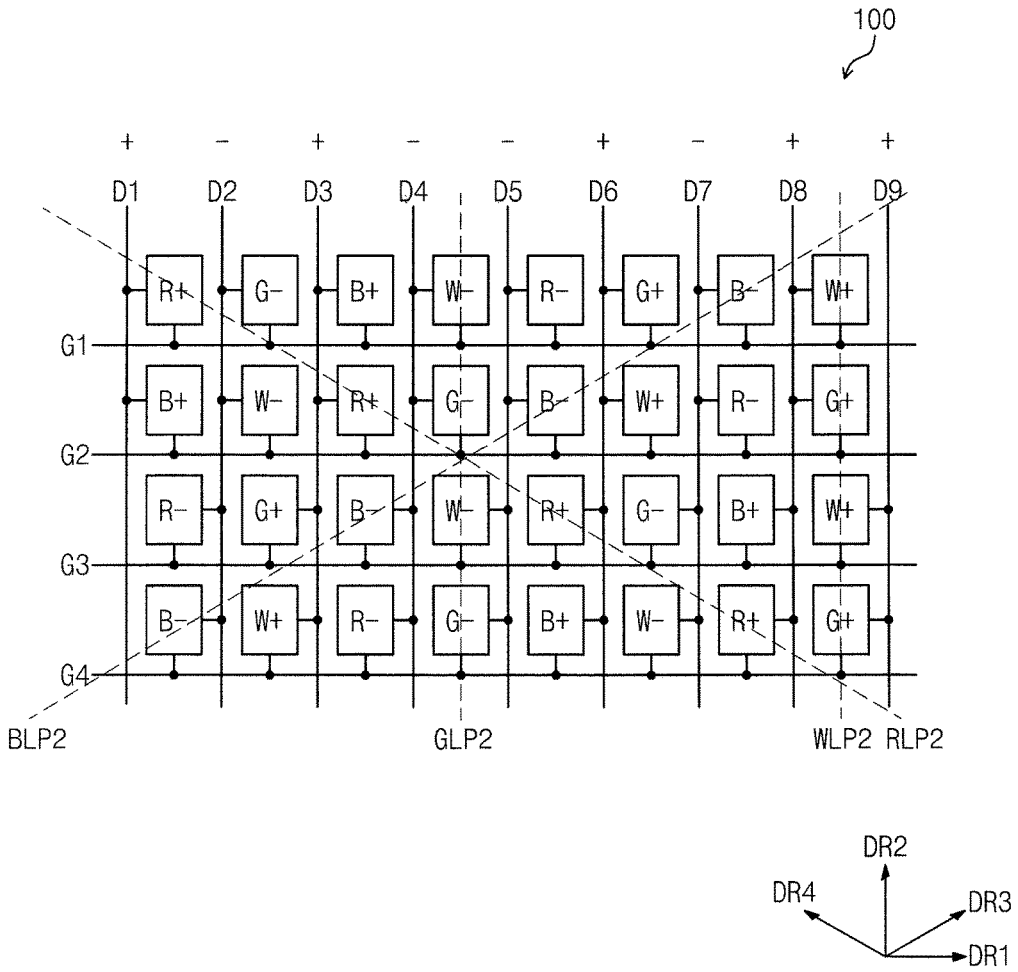
FIG. 4B is a view showing a liquid crystal panel to which data voltages having a second polarity arrangement are applied.
Figure 4C:
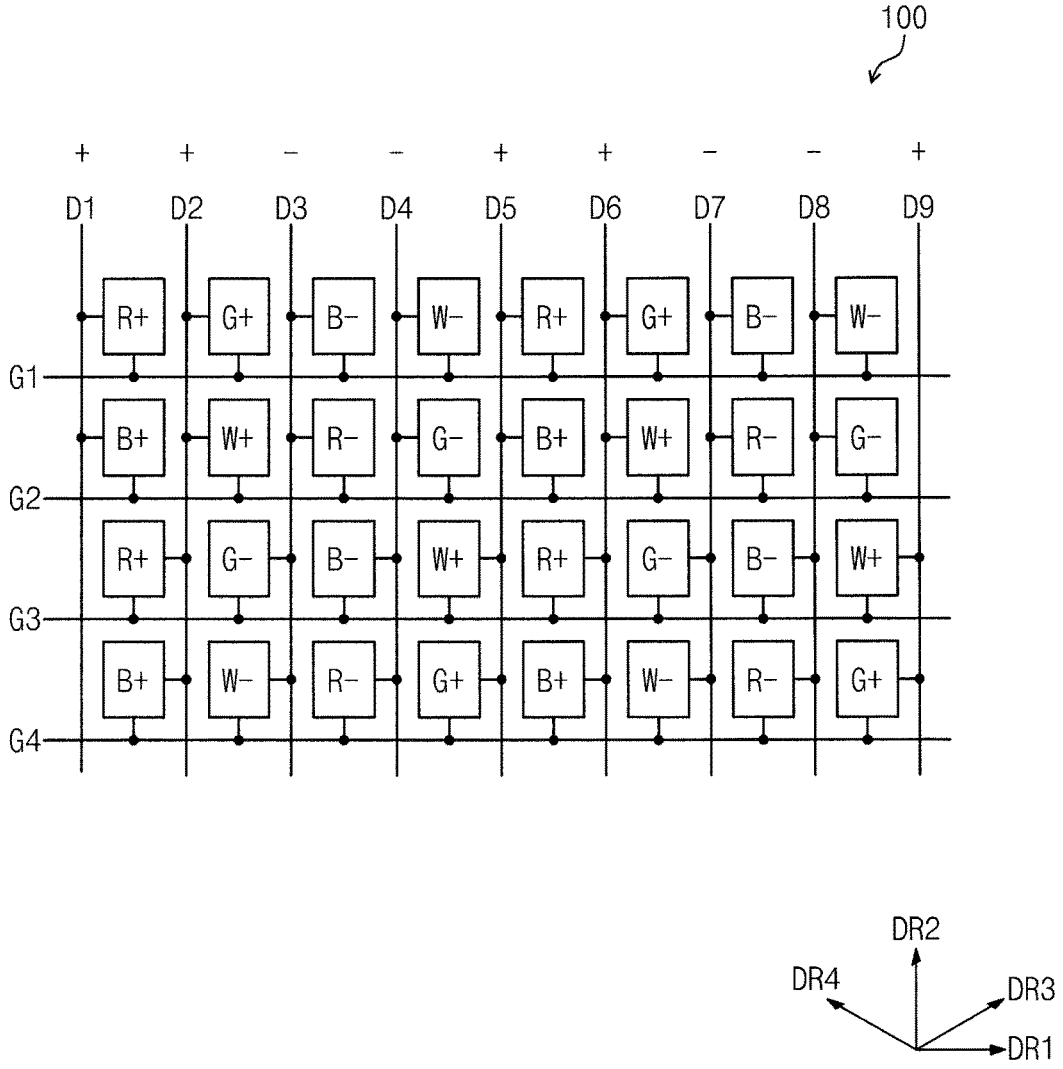
FIG. 4C is a view showing a liquid crystal panel to which data voltages having a third polarity arrangement are applied.
Figure 4D:
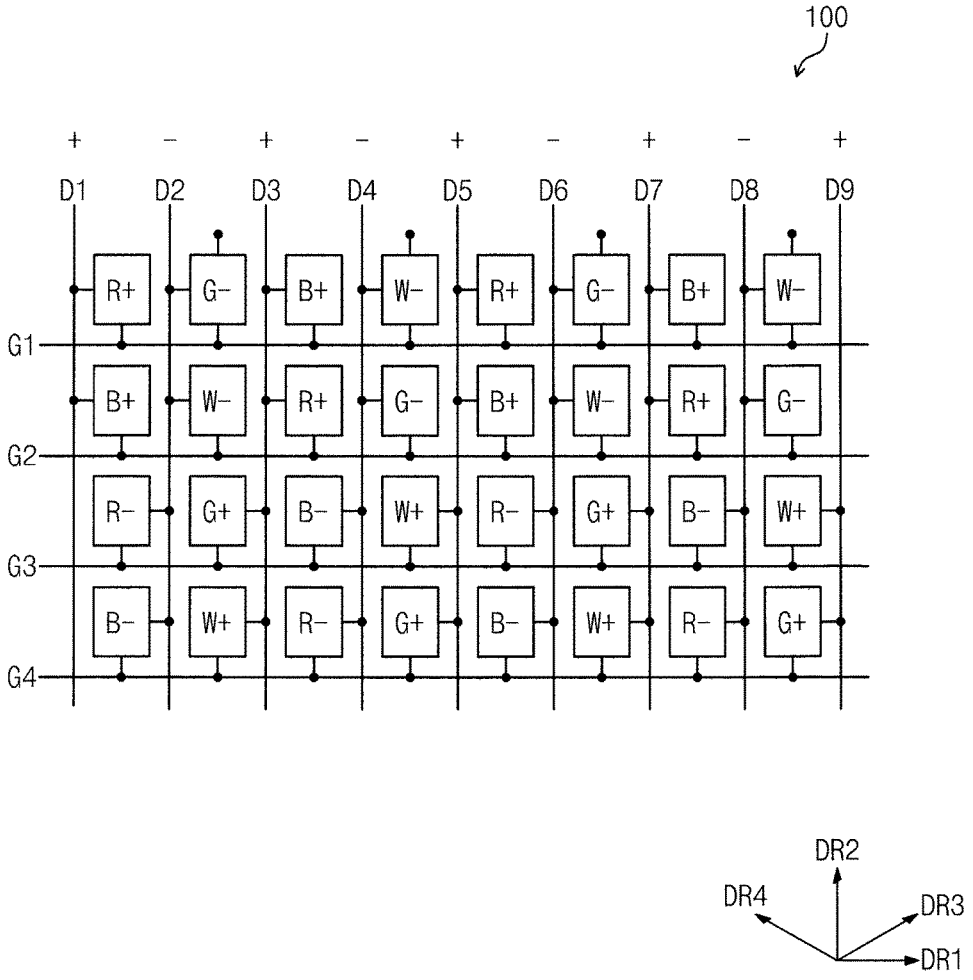
FIG. 4D is a view showing a liquid crystal panel to which data voltages having a fourth polarity arrangement are applied.

FIG. 4A is a view showing a liquid crystal panel to which the data voltages having the first polarity arrangement are applied. FIG. 4B is a view showing a liquid crystal panel to which the data voltages having the second polarity arrangement are applied. FIG. 4C is a view showing a liquid crystal panel to which the data voltages having the third polarity arrangement are applied. FIG. 4D is a view showing a liquid crystal panel to which the data voltages having the fourth polarity arrangement are applied.

In FIGS. 4A to 4D, the pixels that have applied thereto the data voltages having the positive (+) polarity are indicated by R+, G+, B+, and W+, respectively, and the pixels that have applied thereto the data voltages having the negative (−) polarity are indicated by R−, G−, B−, and W−, respectively. The polarities of the data voltages applied to the pixels of the liquid crystal panel 100 shown in FIGS. 4A to 4D correspond to polarities of the pixels in an i-th frame period, and thus the polarities of the pixels in an (i+1)th frame period are obtained by inverting the polarities of the pixels in the i-th frame period.

The data voltages corresponding to one frame period may have one of the first to fourth polarity arrangements.

In the present exemplary embodiment, the polarities the first and second polarity arrangements are inverted in the unit of k (where k is a natural number) data lines (i.e., are inverted every k data lines), the polarities of the third polarity arrangement are inverted in the unit of i (where i is a natural number smaller than k) data lines, and the polarities of the fourth polarity arrangement are inverted in the unit of p (p is a natural number smaller than i) data lines.

In the present exemplary embodiment, k is an integer multiple of i, and i is an integer multiple of p. For instance, k is 4, i is 2, and p is 1.

In the present exemplary embodiment, the polarities of the first and second polarity arrangements are inverted in the unit of four data lines. The first polarity arrangement is different from the second polarity arrangement. The polarities of the first polarity arrangement are +, +, −, +, −, −, +, and − corresponding to respective ones of the consecutive eight data lines. Here, the data voltages having the positive polarity are indicated by "+" and the data voltages having the negative polarity are indicated by "−". The polarities of the second polarity arrangement are +, −, +, −, −, +, −, and + corresponding to respective ones of the consecutive eight data lines.

In the present exemplary embodiment, the polarities of the third polarity arrangement are inverted in the unit of two data lines. The polarities of the third polarity arrangement are +, +, −, −, +, +, − and − corresponding to respective ones of the consecutive eight data lines.

In the present exemplary embodiment, the polarities of the fourth polarity arrangement are inverted in the unit of one data line. The polarities of the fourth polarity arrangement are +, −, +, −, +, −, + and − corresponding to respective ones of the consecutive eight data lines.

When the data voltages having the first polarity arrangement or the second polarity arrangement are applied to the first to fourth color pixels R, G, B, and W, first, second, third, and fourth color line patterns may be defined.

Each of the first to fourth color line patterns includes pixels disposed adjacent to each other in a specific direction, has applied thereto the data voltages having the same polarity, and displays the same color.

When the data voltages having the first polarity arrangement are applied to the first to fourth color pixels R, G, B, and W, a portion of the first to fourth color line patterns may extend in the second direction DR2 and the other portion of the first to fourth color line patterns may not extend in the second direction DR2. For instance, the first and second color line patterns extend in the second direction DR2 and the third and fourth color line patterns extend in a direction crossing the first and second directions DR1 and DR2.

Referring to FIG. 4A, the red pixels R+ included in the first pixel column form a red line pattern RLP1. The blue pixels B− included in the third pixel column form a blue line pattern BLP1. The red line pattern RLP1 and the blue line pattern BLP1 extend in the second direction DR2.

A first-row eighth-column white pixel W−, a second-row sixth-column white pixel W−, a third-row fourth-column white pixel W−, and a fourth-row second-column white pixel W− form a white line pattern WLP1. The white line pattern WLP1 extends in a third direction DR3 crossing the first and second directions DR1 and DR2.

A first-row second-column green pixel G+, a second-row fourth-column green pixel G+, a third-row sixth-column green pixel G+, and a fourth-row eighth-column green pixel G+ form a green line pattern GLP1. The green line pattern GLP1 extends in a fourth direction DR4 crossing the first to third directions DR1 to DR3.

In the case in which the data voltages having the second polarity arrangement are applied to the first to fourth color pixels R, G, B, and W, directions in which the first to fourth color line patterns extend may be different from directions in which the first to fourth color line patterns extend when the data voltages having the first polarity arrangement are applied to the first to fourth color pixels R, G, B, and W.

The first and second color line patterns extend in a direction crossing the first and second directions DR1 and DR2 and the third and fourth color line patterns extend in the second direction DR2.

Referring to FIG. 4B, the green pixels G− included in the fourth pixel column form a green line pattern GLP2. The white pixels W− included in the eighth pixel column form a white line pattern WLP2. The green line pattern GLP2 and the white line pattern WLP2 extend in the second direction DR2.

A first-row seventh-column blue pixel B−, a second-row fifth-column blue pixel B−, a third-row third-column blue pixel B−, and a fourth-row first-column blue pixel B− form a blue line pattern BLP2. The blue line pattern BLP2 extends in the third direction DR3.

A first-row first-column red pixel R+, a second-row third-column red pixel R+, a third-row fifth-column red pixel R+, and a fourth-row seventh-column red pixel R+ form a red line pattern RLP2. The red line pattern RLP2 extends in the fourth direction DR4.

Figure 5:
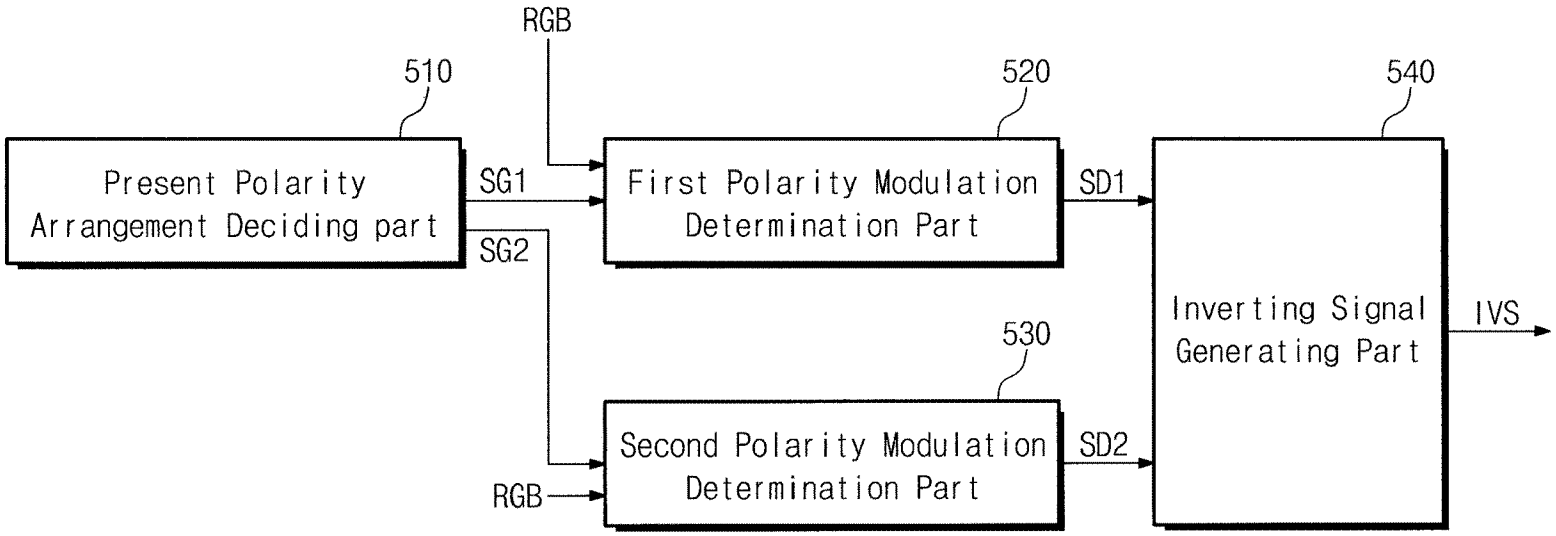
FIG. 5 is a block diagram showing a polarity determination part shown in FIG. 1.

FIG. 5 is a block diagram showing the polarity determination part 500 shown in FIG. 1.

Referring to FIG. 5, the polarity determination part 500 includes a present polarity arrangement deciding part (e.g., a present polarity arrangement decider) 510, a first polarity modulation determination part (e.g., a first polarity modulation determination circuit) 520, a second polarity modulation determination part (e.g., a second polarity modulation determination circuit) 530, and an inverting signal generating part (e.g., an inverting signal generator) 540.

The present polarity arrangement deciding part 510 decides whether a present polarity arrangement is any one of the first to fourth polarity arrangements.

In the case in which the present polarity arrangement corresponds to one of the first and second polarity arrangements, the present polarity arrangement deciding part 510 applies a first analyzing signal SG1 to the first polarity modulation determination part 520. In the case in which the present polarity arrangement corresponds to one of the third and fourth polarity arrangements, the present polarity arrangement deciding part 510 applies a second analyzing signal SG2 to the second polarity modulation determination part 530.

The first polarity modulation determination part 520 receives the first analyzing signal SG1 and the image data RGB. Responsive to the first analyzing signal SG1, the first polarity modulation determination part 520 analyzes a color ratio of the image data RGB and determines whether to change the present polarity arrangement to another one of the first and second polarity arrangements. For instance, in the case in which the present polarity arrangement is the first polarity arrangement, the first polarity modulation determination part 520 determines whether to change the first polarity arrangement to the second polarity arrangement and outputs the determination as a first determination signal SD1.

The second polarity modulation determination part 530 receives the second analyzing signal SG2 and the image data RGB. Responsive to the second analyzing signal SG2, the second polarity modulation determination part 530 analyzes whether the unit pattern is detected from the image data RGB and determines whether to change the present polarity arrangement to another one of the third and fourth polarity arrangements. For instance, in the case in which the present polarity arrangement is the third polarity arrangement, the second polarity modulation determination part 530 determines whether to change the third polarity arrangement to the fourth polarity arrangement and outputs the determination as a second determination signal SD2.

The inverting signal generating part 540 receives the first and second determination signals SD1 and SD2 and generates an inverting signal IVS as one polarity arrangement of the first to fourth polarity arrangements.

Figure 6:
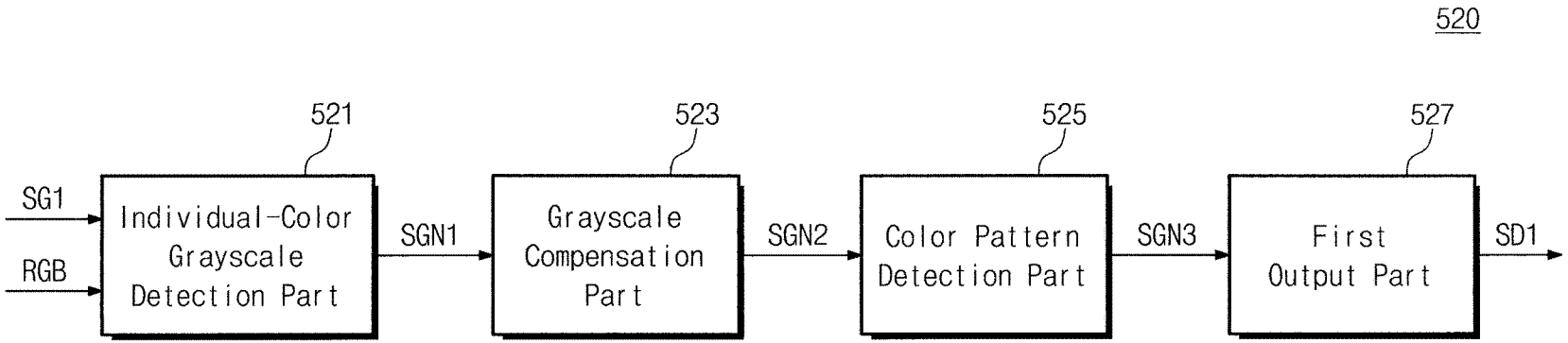
FIG. 6 is a block diagram showing a first polarity modulation determination part shown in FIG. 5.

FIG. 6 is a block diagram showing the first polarity modulation determination part 520 shown in FIG. 5.

Referring to FIG. 6, the first polarity modulation determination part 520 includes an individual-color grayscale detection part (e.g., an individual-color grayscale detector) 521, a grayscale compensation part (e.g., a grayscale compensator) 523, a color pattern detection part (e.g., a color pattern detector) 525, and a first output part (e.g., a first output circuit) 527.

Responsive to the first analyzing signal SG1, the individual-color grayscale detection part 521 analyzes the image data RGB to detect grayscale values of the red, green, and blue colors of the pixel data corresponding to one pixel. According to an embodiment, the individual-color grayscale detection part 521 may further detect a grayscale value of the white color of the pixel data. The individual-color grayscale detection part 521 outputs the detected grayscale values of the pixel data as a detection signal SGN1.

The grayscale compensation part 523 receives the detection signal SGN1 and applies an individual-color weighted value and an individual-color brightness ratio to the individual-color grayscale value of the pixel data to compensate the individual-color grayscale value. The grayscale compensation part 523 outputs the compensated grayscale value for each of the colors of the pixel data as a compensation signal SGN2.

Because a difference in color between the red, green, and blue colors exists, the grayscale compensation part 523 may compensate the difference in brightness between the colors.

According to the structure and the polarity arrangement of the liquid crystal panel 100, a color relatively more sensitive to image quality may be selected from the red, green, blue, and white colors in the image data RGB corresponding to one frame period. Different weighted values may be assigned to the color relatively more sensitive to the image quality and the color relatively less sensitive to the image quality. For instance, referring again to FIG. 4A, in the liquid crystal panel 100 that receives (e.g., has applied thereto) the data voltages having the first polarity arrangement, the red line pattern and the blue line pattern extend in the second direction DR2 and the green line pattern and the white line pattern extend in the direction crossing the first and second directions DR1 and DR2.

Although a difference in data voltage does not exist between the pixel receiving (e.g., having applied thereto) the data voltage having the positive polarity and the pixel receiving (e.g., having applied thereto) the data voltage having the negative polarity, a brightness difference may occur. A color line pattern extending in a specific direction may seem to move (e.g., as perceived by a user) when a frame period is changed to another frame period. The phenomenon that the color line pattern seems to move is called a moving line-stain.

The red and blue line patterns extending in the second direction DR2 are more easily perceived as the moving line-stain than the white line pattern extending in the third direction DR3 and the green line pattern extending in the fourth direction DR4. In the case in which the color ratio of the red and blue colors is relatively high in the image data RGB, the moving line-stain is much more perceived when the data voltages having the first polarity arrangement are applied to the liquid crystal panel 100 than that when the data voltages having the second polarity arrangement are applied to the liquid crystal panel 100.

The red and blue colors are more vulnerable to the moving line-stain and more sensitive to the image quality than the green and white colors in the liquid crystal panel 100 to which the data voltages having the first polarity arrangement are applied. Accordingly, in the case in which the first polarity arrangement is applied to the structure of the liquid crystal panel 100 shown in FIG. 3, the grayscale compensation part 523 applies a relatively high weighted value to the red and blue colors as compared to the green and white colors.

The compensated grayscale value of the red color, the compensated grayscale value of the green color, and the compensated grayscale value of the blue color may be determined by the following Equation 1.

$$R_gray = R_data \times RH \times RW$$

$$G_gray = G_data \times GH \times GW$$

$$B_gray = B_data \times BH \times BW \qquad \text{Equation 1}$$

In Equation 1, R_gray denotes the compensated grayscale value of the red color of the pixel data, R_data denotes the grayscale value of the red color of the pixel data, RH denotes the brightness ratio of the red color, and RW denotes the weighted value of the red color. G_gray denotes the compensated grayscale value of the green color of the pixel data, G_data denotes the grayscale value of the green color of the pixel data, GH denotes the brightness ratio of the green color, and GW denotes the weighted value of the green color. B_gray denotes the compensated grayscale value of the blue color of the pixel data, B_data denotes the grayscale value of the blue color of the pixel data, BH denotes the brightness ratio of the blue color, and BW denotes the weighted value of the blue color. In the present exemplary embodiment, RH is about 0.2, GH is about 0.7, and BH is about 0.1.

The color pattern detection part 525 receives the compensation signal SGN2 and determines whether the color pattern, in which the polarity arrangement is changed in the image data RGB of the one frame period, is detected on the basis of the color ratio of the image data RGB. The color pattern detection part 525 outputs, as a detection signal SGN3, the determined result that indicates whether the color pattern, in which the polarity arrangement is changed in the image data RGB of the one frame period, is detected.

The color pattern detection part 525 analyzes the compensated grayscale value for each of the colors in the unit of at least one pixel data.

In the case in which the color pattern detection part 525 analyzes the compensated grayscale value in the unit of one pixel data, the color pattern detection part 525 may determine whether the compensated grayscale value of each individual color of the pixel data is equal to or greater than a red reference grayscale value, a green reference grayscale value, and a blue reference grayscale value. For instance, in the case in which the number of the pixel data equal to or greater than the red reference grayscale value is equal to or greater than a set or predetermined value, the number of the pixel data equal to or smaller than the green reference grayscale value is equal to or smaller than a set or predetermined value, and the number of the pixel data equal to or smaller than the blue reference grayscale value is equal to or smaller than a set or predetermined value, a red color component in the image data RGB may be much more than the green and blue components in the image data RGB.

In some examples, the color pattern detection part 525 may analyze the compensated grayscale value for each of the colors in the unit of pixel row data corresponding to the pixels included in one pixel row. The color pattern detection part 525 may determine whether the compensated grayscale value of each individual color of the pixel row data is equal to or greater than a red reference grayscale value, a green reference grayscale value, and a blue reference grayscale value. For instance, in the case in which the pixel row data equal to or greater than the red reference grayscale value is equal to or greater than a set or predetermined value, the pixel row data equal to or smaller than the green reference grayscale value is equal to or smaller than a set or predetermined value, and the pixel data equal to or smaller than the blue reference grayscale value is equal to or smaller than a set or predetermined value, the red color component in the image data RGB may be much more than the green and blue components in the image data RGB.

When the data voltages having the first polarity arrangement are applied to the liquid crystal panel 100, and the color ratio of the red and blue colors is greater than that of the green and white colors, the color pattern detection part 525 determines that the color pattern, in which the polarity arrangement is changed, is detected from the image data RGB.

The first output part 527 receives the color pattern detection signal SGN3 and outputs a first determination signal SD1. The first determination signal SD1 includes information about the changing of the present polarity arrangement.

The first output part 527 determines that the present polarity arrangement is maintained when the image data RGB do not correspond to the color pattern in which the polarity arrangement is changed.

When the image data RGB correspond to the color pattern in which the polarity arrangement is changed, the first output part 527 determines whether the number of frame periods during which the image data RGB having the color pattern, in which the polarity arrangement is changed, are consecutively input is equal to or greater than a set or predetermined number of frame periods. In the case in which the number of frame periods during which the image data RGB having the color pattern, in which the polarity arrangement is changed, are consecutively input smaller than the set or predetermined number of frame periods, the first output part 527 determines that the present polarity arrangement is maintained. In the case in which the number of frame periods during which the image data RGB having the color pattern, in which the polarity arrangement is changed, are consecutively input is equal to or greater than the set or predetermined number of frame periods, the first output part 527 determines that the present polarity arrangement is changed to one of the first and second polarity arrangements.

According to the liquid crystal panel 100, when the pattern in which the moving line-stain occurs is detected, the present polarity arrangement is changed, and thus the moving line-stain is prevented or substantially prevented from being perceived.

Figure 7:
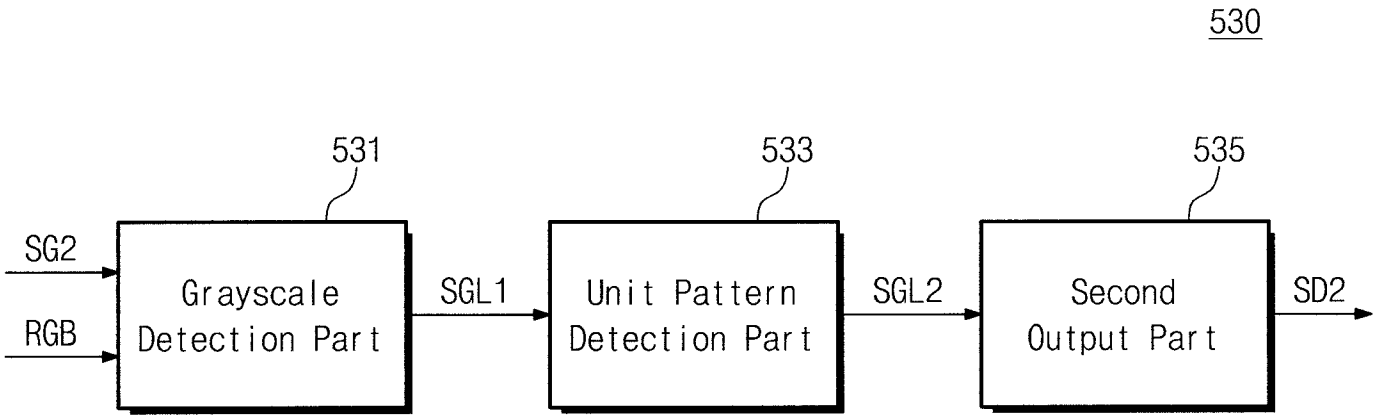
FIG. 7 is a block diagram showing a second polarity modulation determination part shown in FIG. 5.

FIG. 7 is a block diagram showing the second polarity modulation determination part 530 shown in FIG. 5.

Referring to FIG. 7, the second polarity modulation determination part 530 includes a grayscale detection part (e.g., a grayscale detector) 531, a unit pattern detection part (e.g., a unit pattern detector) 533, and a second output part (e.g., a second output circuit) 535.

Responsive to the second analyzing signal SG2, the grayscale detection part 531 analyzes the image data RGB and detects the grayscale value of the pixel data corresponding to one pixel. The grayscale detection part 531 outputs the grayscale value of the pixel data as a grayscale signal SGL1.

The unit pattern detection part 533 receives the grayscale signal SGL1 and determines whether the unit pattern is detected from the image data RGB. The unit pattern detection part 533 determines the grayscale value of the pixel data as a high grayscale value when the grayscale value of the pixel data is equal to or greater than a set or predetermined value, and determines the grayscale value of the pixel data as a low grayscale value when the grayscale value of the pixel data is smaller than the set or predetermined value. The unit pattern detection part 533 outputs a unit pattern detection signal SGL2 for indicating whether the unit pattern is detected from the image data RGB.

When a sum of polarities of the data voltages applied to the pixels during one horizontal scan period is biased to a positive or negative polarity, the common voltage is not constantly maintained due to a coupling phenomenon between the data lines and the common electrode and a ripple occurs in a positive or negative direction with respect to the common voltage. In this case, a difference in brightness occurs between adjacent regions to a region in which the image is displayed and the surrounding area, which is referred to as a horizontal crosstalk phenomenon.

The unit pattern may be a pattern in which the horizontal crosstalk phenomenon occurs according to the structure of the liquid crystal panel 100 and the present polarity arrangement.

Figure 8:
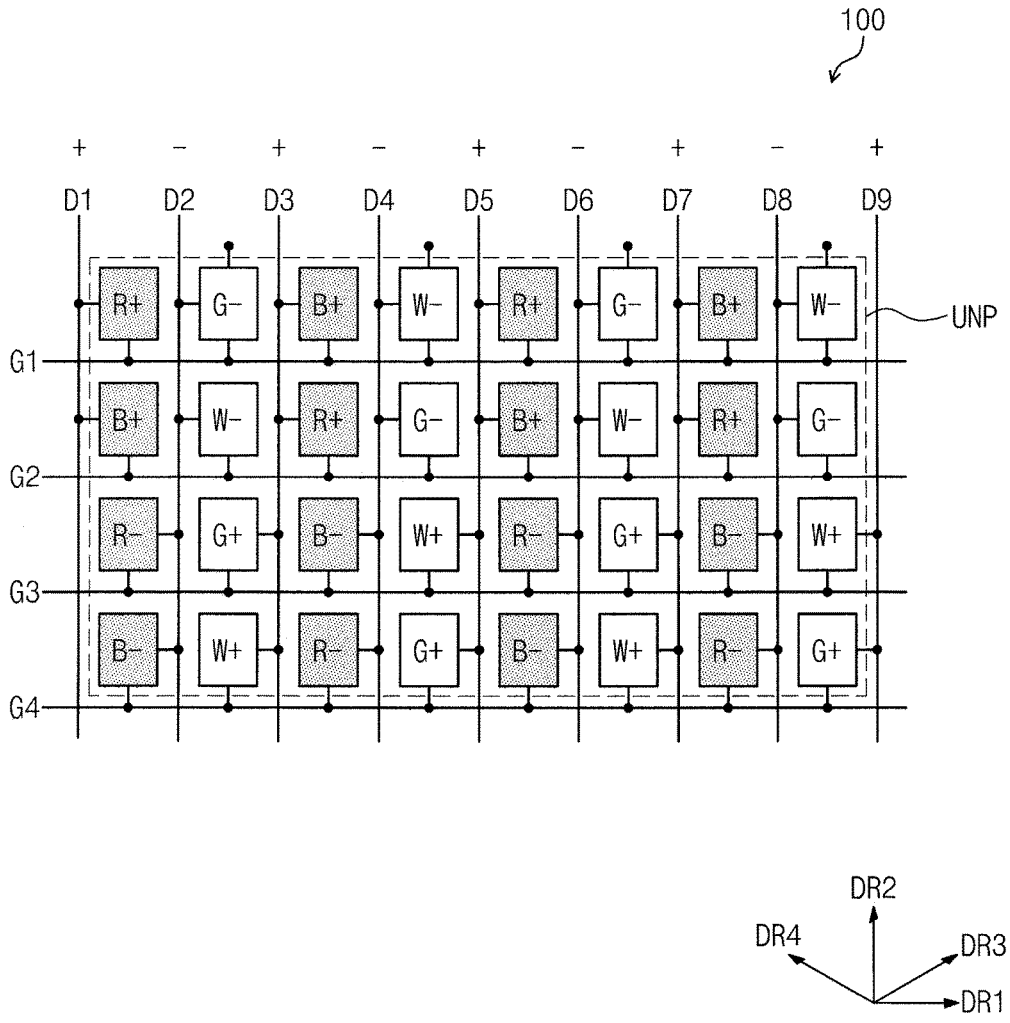
FIG. 8 is a view showing a unit pattern displayed in the liquid crystal panel shown in FIG. 3, to which the fourth polarity arrangement is applied.

FIG. 8 is a view showing a unit pattern UNP displayed in the liquid crystal panel 100 shown in FIG. 3, to which the fourth polarity arrangement is applied.

In FIG. 8, the pixels receiving (e.g., having applied thereto) the data voltages having the high grayscale value are hatched and the pixels receiving (e.g., having applied thereto) the data voltages having the low grayscale value are not hatched. FIG. 8 shows the unit pattern UNP corresponding to the pixels arranged in a matrix form of four rows by eight columns as a representative example. In the unit pattern UNP shown in FIG. 8, the grayscale value of the pixel data corresponding to the pixels included in first, third, fifth, and seventh pixel columns is the high grayscale value and the grayscale value of the pixel data corresponding to the pixels included in second, fourth, sixth, and eighth pixel columns is the low grayscale value; however, embodiments of the present disclosure are not limited thereto or thereby.

The unit pattern UNP may be changed according to the structure of the liquid crystal panel 100 and the polarity arrangement of the data voltages applied to the liquid crystal panel 100.

Referring again to FIG. 7, the second output part 535 receives the unit pattern detection signal SGL2 and outputs the second determination signal SD2. The second determination signal SD2 includes information about the changing of the present poly arrangement.

When the unit pattern is not detected in the image data RGB, the second output part 535 determines that the present polarity arrangement is maintained.

The second output part 535 determines whether the unit pattern is detected in the image data RGB corresponding to one frame period and the number of the detected unit patterns is equal to or greater than a set or predetermined number. When the number of the detected unit patterns in the image data RGB corresponding to one frame period is smaller than the set or predetermined number, the second output part 535 determines that the present polarity arrangement is maintained. When the number of the detected unit patterns in the image data RGB corresponding to one frame period is equal to or greater than the set or predetermined number, the second output part 535 determines that the present polarity arrangement is changed to another one of the third and fourth polarity arrangements.

Figure 9:
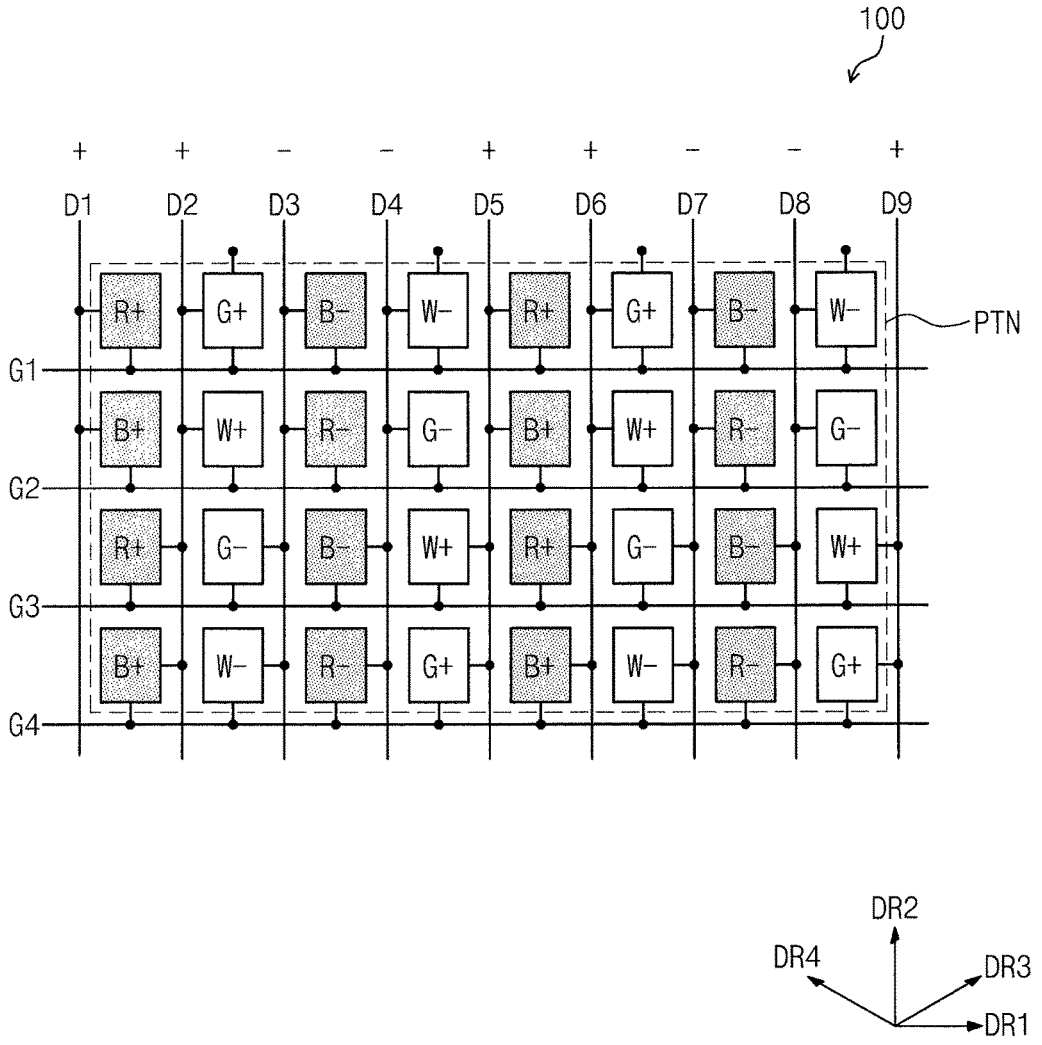
FIG. 9 is a view showing an image pattern displayed when the third polarity arrangement is applied to the liquid crystal panel shown in FIG. 3.

FIG. 9 is a view showing an image pattern PTN displayed when the third polarity arrangement is applied to the liquid crystal panel 100 shown in FIG. 3. The image pattern PTN may be, but is not limited to, the unit pattern PTN shown in FIG. 8.

Referring to FIGS. 8 and 9, when the fourth polarity arrangement is applied to the liquid crystal panel 100, the unit pattern PTN displayed in the liquid crystal panel 100 may cause the horizontal crosstalk. However, when the third polarity arrangement is applied to the liquid crystal panel 100, the image pattern PTN displayed in the liquid crystal panel 100 does not cause the horizontal crosstalk. That is, when the third polarity arrangement is applied to the liquid crystal panel 100, the image pattern PTN displayed in the liquid crystal panel 100 does not correspond to the unit pattern. Although the same pattern is displayed, the horizontal crosstalk may or may not be generated in accordance with the polarity arrangement and the structure of the liquid crystal panel.

The second polarity modulation determination part 530 may change the fourth polarity arrangement to the third polarity arrangement when the number of the unit pattern detected in the image data RGB is equal to or greater than the set or predetermined number.

According to the liquid crystal display 1000, when the pattern in which the moving line-stain occurs is detected, the present polarity arrangement is changed, and thus the moving line-stain is prevented or substantially prevented from being perceived.

Referring again to FIG. 5, the present polarity arrangement is maintained or changed to one of the first to fourth polarity arrangements by the inverting signal IVS output from the inverting signal generating part 540.

When the present polarity arrangement is changed by the inverting signal IVS, the changing of the polarity arrangement may be carried out during a vertical blank period between two frame periods.

Figure 10:
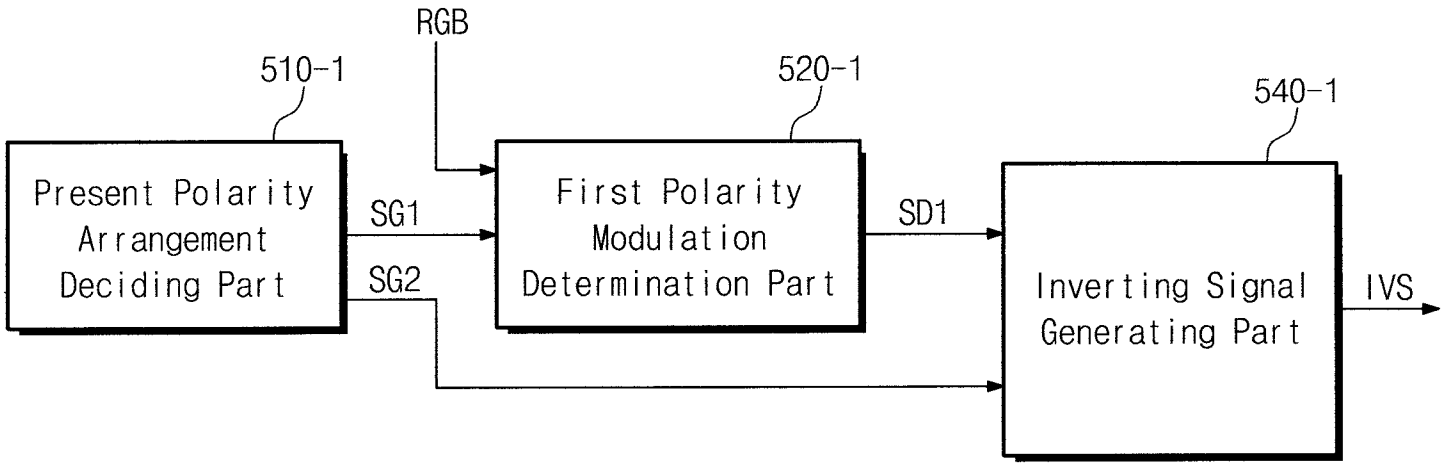
FIG. 10 is a block diagram showing a polarity determination part according to another exemplary embodiment of the present disclosure.

FIG. 10 is a block diagram showing a polarity determination part 500-1 according to another exemplary embodiment of the present disclosure.

The polarity determination part (e.g., the polarity determination circuit) 500-1 shown in FIG. 10 has the same or substantially the same structure and function as those of the polarity determination part 500 shown in FIG. 5, with the exception of the second polarity modulation determination part.

Referring to FIG. 10, the polarity determination part 500-1 changes the present polarity arrangement in the case in which the present polarity arrangement corresponds to one of the first and second polarity arrangements and is required to be changed to another one of the first and second polarity arrangements. The polarity determination part 500-1 does not change the present polarity arrangement in the case in which the present polarity arrangement corresponds to one of the first and second polarity arrangements and is not required to be changed to another one of the first and second polarity arrangements. In addition, the polarity determination part 500-1 does not change the present polarity arrangement in the case in which the present polarity arrangement corresponds to one of the third and fourth polarity arrangements.

The polarity determination part 500-1 includes a present polarity arrangement deciding part (e.g., a present polarity arrangement deciding circuit) 510-1, a first polarity modulation determination part (e.g., a first polarity modulation determination circuit) 520-1, and an inverting signal generating part (e.g., an inverting signal generator) 540-1. The present polarity arrangement deciding part 510-1, the first polarity modulation determination part 520-1, and the inverting signal generating part 540-1 are substantially the same as the present polarity arrangement deciding part 510, the first polarity modulation determination part 520, and the inverting signal generating part 540 described with reference to FIG. 5, and thus details thereof may not be repeated here.

Figure 11:
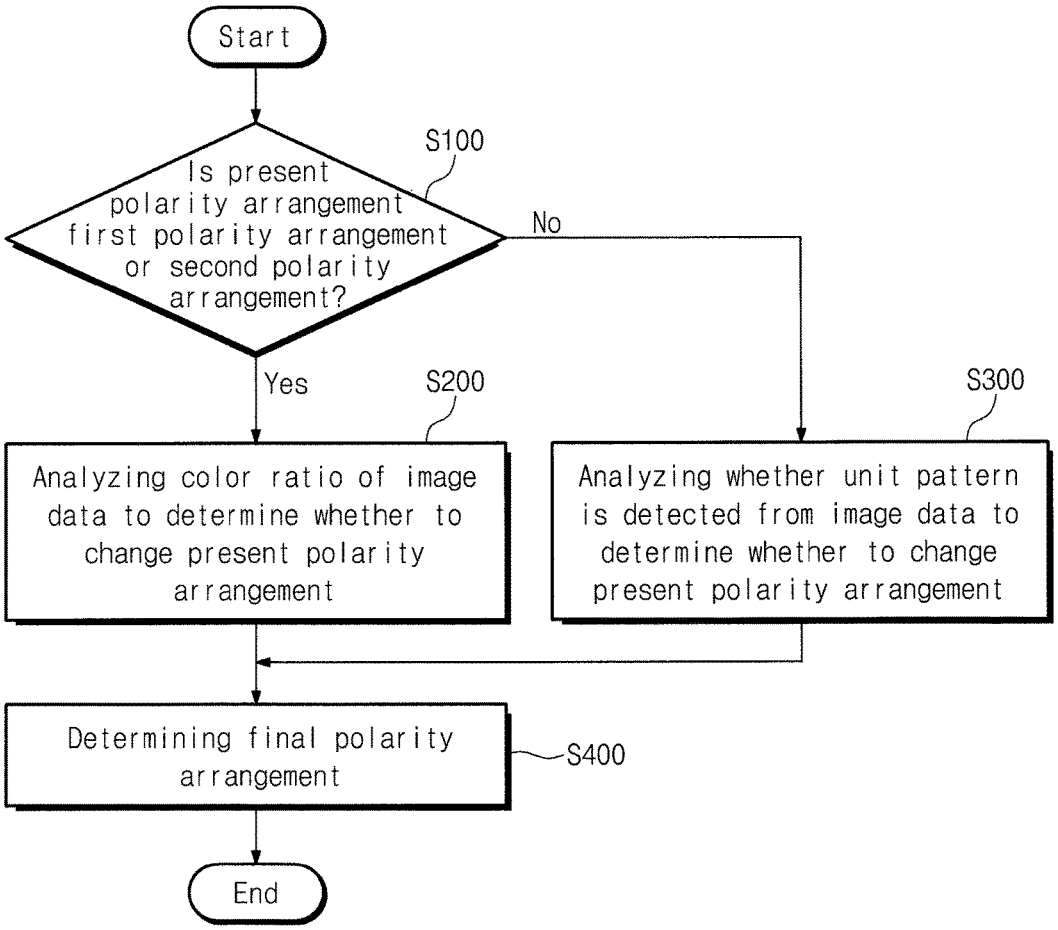
FIG. 11 is a flow diagram showing a method of driving a display device according to an exemplary embodiment of the present disclosure.

FIG. 11 is a flow diagram showing a method of driving a display device according to an exemplary embodiment of the present disclosure.

Referring to FIG. 11, it is determined whether the present polarity arrangement applied to the image data corresponds to the first or second polarity arrangement among the first to fourth polarity arrangements (S100). In the case in which the present polarity arrangement is the first or second polarity arrangement, an operation (S200) is carried out, and in the case in which the present polarity arrangement is the third or fourth polarity arrangement, another operation (S300) is carried out.

Then, the color ratio of the image data is analyzed and it is determined whether to change the present polarity (S200).

After that, it is analyzed whether the unit pattern is detected in the image pattern and it is determined whether to change the present polarity (S300).

In an operation (S400), a final polarity arrangement is determined on the basis of the determined results in the operations (S200 and S300). Then, the data voltages having the final polarity arrangement are applied to the liquid crystal panel.

Figure 12:
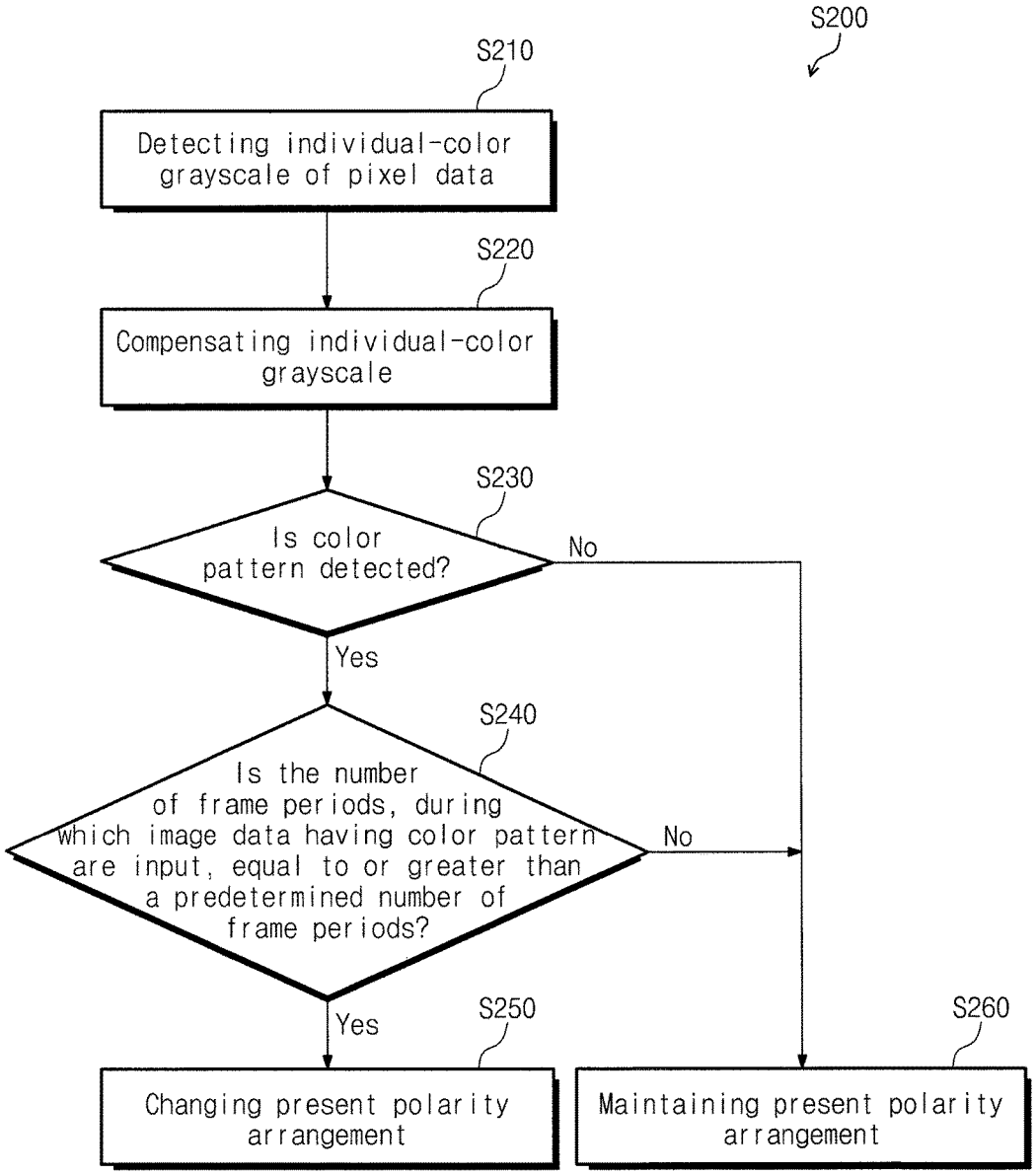
FIG. 12 is a flow diagram showing changing of a polarity arrangement on the basis of a color ratio of image data shown in FIG. 11.

FIG. 12 is a flow diagram showing the changing of a polarity arrangement on the basis of the color ratio (S200) of the image data shown in FIG. 11.

Referring to FIGS. 12 and 6, the image data RGB are analyzed to detect the red, green, and blue grayscale value of the pixel data (S210). In an operation (S220), the individual-color weighted value and the individual-color brightness ratio are applied to compensate the individual-color grayscale value of the pixel data.

Then, it is determined whether the color pattern, in which the polarity arrangement is changed, is detected in the image data RGB on the basis of the color ratio of the image data RGB (S230). In the case in which the color pattern, in which the polarity arrangement is changed, is detected in the image data RGB, an operation (S240) is carried out. In the case in which the color pattern, in which the polarity arrangement is changed, is not detected in the image data RGB, an operation (S260) is carried out.

After that, it is determined whether the number of frame periods during which the image data RGB having the color pattern, in which the polarity arrangement is changed, are consecutively input is equal to or greater than the set or predetermined number of frame periods (S240). In the case in which the number of frame periods during which the image data RGB having the color pattern, in which the polarity arrangement is changed, are consecutively input is equal to or greater than the set or predetermined number of frame periods, the present polarity arrangement is changed (S250). In the case in which the number of frame periods during which the image data RGB having the color pattern, in which the polarity arrangement is changed, are consecutively input is smaller than the set or predetermined number of frame periods, the present polarity arrangement is maintained (S260).

Figure 13:
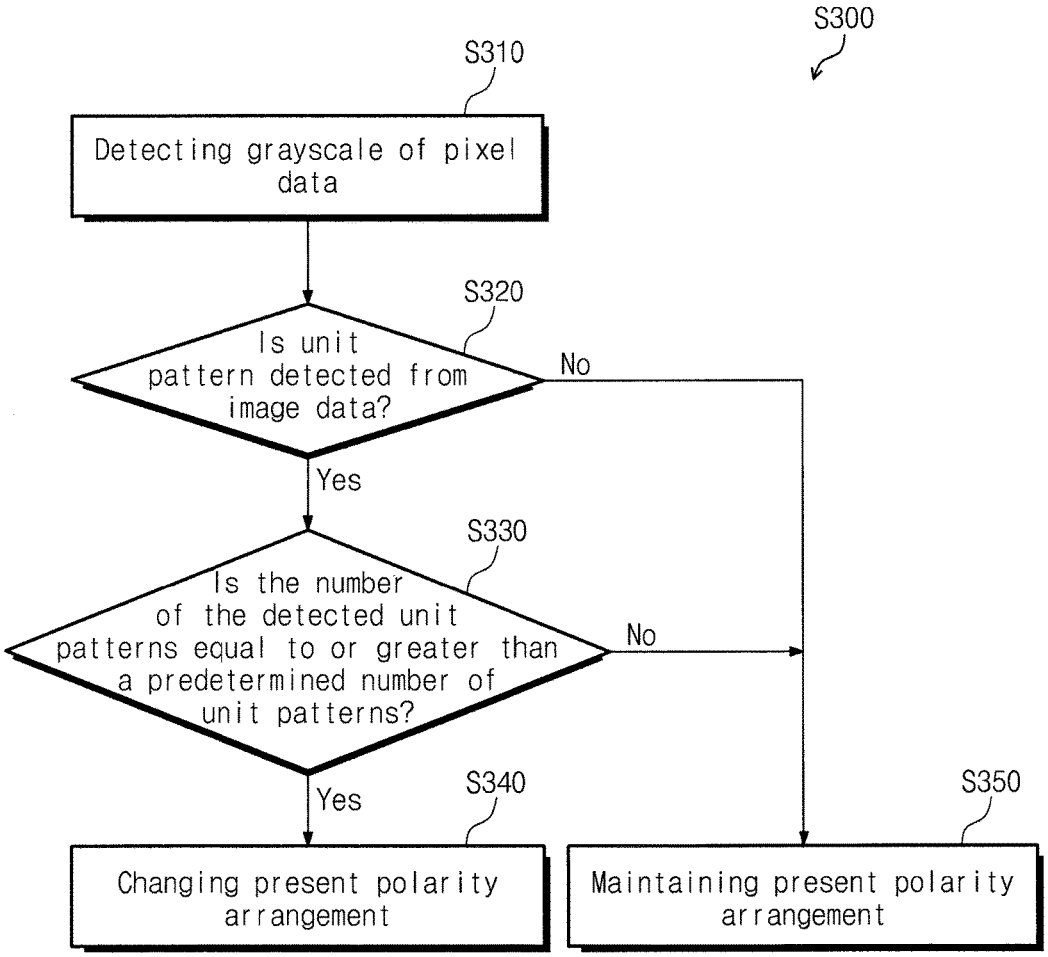
FIG. 13 is a flow diagram showing changing of a polarity arrangement on the basis of a unit pattern of image data shown in FIG. 11.

FIG. 13 is a flow diagram showing the changing of the polarity arrangement on the basis of the unit pattern of image data (S300) shown in FIG. 11.

Referring to FIGS. 13 and 7, the image data RGB are analyzed to detect the grayscale value of the image data RGB (S310).

Then, it is determined whether the unit pattern is detected in the image data RGB (S320). In the case in which the unit pattern is detected in the image data RGB, an operation (S330) is carried out. In the case in which the unit pattern is not detected in the image data RGB, an operation (S350) is carried out to maintain the present polarity arrangement.

After that, it is determined whether the number of the detected unit patterns in the image data RGB corresponding to one frame period is equal to or greater than the set or predetermined number (S330). In the case in which the number of the detected unit patterns in the image data RGB corresponding to one frame period is equal to or greater than the set or predetermined number, the present polarity arrangement is changed (S340). In the case in which the number of the detected unit patterns in the image data RGB corresponding to one frame period is smaller than the set or predetermined number, the present polarity arrangement is maintained (S350).

It will be understood that, although the terms "first", "second", "third", etc., may be used herein to describe various elements, components, regions, and/or sections, these elements, components, regions, and/or sections should not be limited by these terms. These terms are used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display device and/or any other relevant devices or components, such as the polarity determination part 500 and its constituent components, according to embodiments of the present disclosure described herein may be implemented utilizing any suitable hardware, firmware (e.g. an application-specific integrated circuit), software, or a suitable combination of software, firmware, and hardware. For example, the various components of the display device may be formed on one integrated circuit (IC) chip or on separate IC chips. Further, the various components of the display device may be implemented on a flexible printed circuit film, a tape carrier package (TCP), a printed circuit board (PCB), or formed on a same substrate. Further, the various components of the display device may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present disclosure.

Although exemplary embodiments of the present invention have been described, it is understood that the present invention should not be limited to these exemplary embodiments but various suitable changes and modifications can be made by one ordinary skilled in the art within the spirit and scope of the present invention, which is defined by the following claims and their equivalents.

What is claimed is:

1. A liquid crystal display comprising:

a liquid crystal panel comprising a plurality of gate lines extending in a first direction, a plurality of data lines extending in a second direction crossing the first direction, and a plurality of pixels connected to the gate lines and the data lines;

a gate driver configured to apply gate signals to the gate lines;

a data driver configured to apply data voltages to the data lines; and a timing controller configured to receive a control signal and image data, to apply a gate control signal to the gate driver, and to apply a data control signal to the data driver, wherein the timing controller is further configured to determine whether to change a present polarity arrangement on a basis of a color ratio of the image data, wherein the timing controller comprises:

a present polarity arrangement decider configured to determine whether the present polarity arrangement is any one of a first polarity arrangement, a second polarity arrangement, a third polarity arrangement, and a fourth polarity arrangement;

a first polarity modulation determination circuit configured to analyze the color ratio of the image data when the present polarity arrangement is one of the first and second polarity arrangements, and to determine whether to change the present polarity arrangement to another one of the first and second polarity arrangements; and an inverting signal generator configured to generate an inverting signal determined by one polarity arrangement among the first to fourth polarity arrangements in accordance with the determination of the present polarity arrangement decider and the first polarity modulation determination circuit, and wherein the first polarity modulation determination circuit comprises:

an individual-color grayscale detector configured to analyze the image data to detect an individual-color grayscale value of pixel data;

a grayscale compensator configured to apply an individual-color weighted value and an individual-color brightness ratio to the individual-color grayscale value of the pixel data to compensate the individual-color grayscale value;

a color pattern detector configured to determine whether a color pattern is detected from the image data on the basis of the color ratio of the image data; and a first output circuit configured to determine whether to change the present polarity arrangement in accordance with whether a number of frame periods during which the image data having the color pattern are consecutively input is equal to or greater than a set number of frame periods.

2. The liquid crystal display of claim 1, wherein, when the data voltages having the first polarity arrangement are applied to the liquid crystal panel, first and second color line patterns extend in the second direction and third and fourth color line patterns extend in a direction crossing the first and second directions, and when the data voltages having the second polarity arrangement are applied to the liquid crystal panel, the first and second color line patterns extend in a direction crossing the first and second directions, and the third and fourth color line patterns extend in the second direction.

3. The liquid crystal display of claim 2, wherein a polarity of the first polarity arrangement and a polarity of the second polarity arrangement are inverted every k data lines, k being a natural number.

4. The liquid crystal display of claim 2, wherein the timing controller further comprises a second polarity modulation determination circuit configured to analyze whether a unit pattern is detected from the image data when the present polarity arrangement is one of the third and fourth polarity arrangements, and to determine whether to change the present polarity arrangement to another one of the third and fourth polarity arrangements.

5. The liquid crystal display of claim 4, wherein the second polarity modulation determination circuit comprises:

a grayscale detector configured to analyze the image data to detect a grayscale value of pixel data;

a unit pattern detector configured to determine whether the unit pattern is detected from the image data on a basis of the grayscale value of the pixel data; and a second output circuit configured to determine whether to change the present polarity arrangement in accordance with whether a number of the detected unit patterns is equal to or greater than a set number of the unit patterns in the image data.

6. The liquid crystal display of claim 4, wherein a polarity of the third polarity arrangement is inverted every i data lines of the plurality of data lines, a polarity of the fourth polarity arrangement is inverted every p data lines of the plurality of data lines, wherein i is a natural number smaller than k, and p is a natural number smaller than i.

7. The liquid crystal display of claim 6, wherein k is 4, i is 2, and p is 1.

8. The liquid crystal display of claim 7, wherein the first polarity arrangement is represented as +, +, −, +, −, −, +, and −, the second polarity arrangement is represented as +, −, +, −, −, +, −, and +, the third polarity arrangement is represented as +, +, −, −, +, +, −, and −, and the fourth polarity arrangement is represented as +, −, +, −, +, −, +, and −, wherein + represents a data voltage having a positive polarity and − represents a data voltage having a negative polarity.

9. The liquid crystal display of claim 8, wherein the liquid crystal panel comprises:

a first pixel group;

a second pixel group adjacent to the first pixel group in the first direction;

a third pixel group adjacent to the first pixel group in the second direction; and a fourth pixel group adjacent to the second pixel group in the second direction, each of the first, second, third, and fourth pixel groups comprising an even number of pixels, and the first, second, third, and fourth pixels groups are repeatedly arranged in the first and second directions.

10. The liquid crystal display of claim 9, wherein each of the first and fourth pixel groups comprises two pixels among a red pixel, a green pixel, a blue pixel, and a white pixel, and each of the second and third pixel groups comprises an other two pixels among the red pixel, the green pixel, the blue pixel, and the white pixel.

11. The liquid crystal display of claim 1, wherein the pixels in one pixel column are alternately connected to two data lines of the plurality of data lines in units of at least one pixel and the two data lines are adjacent to each other such that the pixel column is between the two data lines.

12. The liquid crystal display of claim 11, wherein the pixels in one pixel row are connected to a same gate line of the plurality of gate lines.

13. A method of driving a liquid crystal display, the method comprising:

determining whether a present polarity arrangement applied to image data is a first or second polarity arrangement of a first polarity arrangement, a second polarity arrangement, a third polarity arrangement, and a fourth polarity arrangement, the first to fourth polarity arrangements having different polarity arrangements;

analyzing a color ratio of the image data when the present polarity arrangement is the first polarity arrangement or the second polarity arrangement to determine whether to change the present polarity arrangement;

analyzing whether a unit pattern is detected from the image data when the present polarity arrangement is the third polarity arrangement or the fourth polarity arrangement to determine whether to change the present polarity arrangement; and determining a final polarity arrangement on a basis of the determined results with respect to the analyzing of the color ratio and the analysis of the unit pattern, wherein the determining of the present polarity arrangement with respect to the analyzing of the color ratio comprises:

analyzing the image data to detect an individual-color grayscale value of pixel data;

applying an individual-color weighted value and an individual-color brightness ratio to the individual-color grayscale value of the pixel data to compensate the individual-color grayscale value of the pixel data;

determining whether a color pattern having a polarity arrangement to be changed is detected from the image data on a basis of the color ratio of the image data; and determining whether a number of frame periods during which the image data having the color pattern are consecutively input is equal to or greater than a set number of frame periods when the color pattern having the polarity arrangement to be changed is detected from the image data.

14. The method of claim 13, wherein the present polarity arrangement is maintained when the color pattern is not detected or the number of frame periods during which the image data having the color pattern are consecutively input is smaller than the set number of frame periods, and wherein the present polarity arrangement is changed when the color pattern is detected or the number of frame periods during which the image data having the color pattern are consecutively input is equal to or greater than the set number of frame periods.

15. The method of claim 13, wherein the determining of the present polarity arrangement with respect to the detecting of the unit pattern comprises:

analyzing the image data to detect a grayscale value of pixel data;

determining whether the unit pattern is detected from the image data; and determining whether a number of detected unit patterns is equal to or greater than a set number of the unit patterns in the image data corresponding to one frame period.

16. The method of claim 15, wherein the present polarity arrangement is maintain when the unit pattern is not detected or the number of the detected unit patterns is smaller than the set number of the unit patterns in the image data corresponding to one frame period, and the present polarity arrangement is changed when the unit pattern is detected or the number of the detected unit patterns is equal to or greater than the set number of the unit patterns in the image data corresponding to one frame period.

* * * * *